United States Patent [19]

McPherson, Sr.

[11] 4,317,402

[45] Mar. 2, 1982

[54] ACOUSTIC GUITAR

[76] Inventor: Mathew McPherson, Sr., 5817 Olinger Rd., Edina, Minn. 55436

[21] Appl. No.: 229,092

[22] Filed: Jan. 28, 1980

[51] Int. Cl.[3] ..... G10D 1/08

[52] U.S. Cl. ..... 84/291

[58] Field of Search ..... D17/14, 17, 19, 21; 84/173, 267, 268, 291, 292, 297 R, 298, 299, 307

[56] References Cited

U.S. PATENT DOCUMENTS 2,523,963 9/1950 Mitchell ..... 84/267
3,539,699 11/1970 Johnson ..... 84/267 X
4,178,827 12/1979 Mallory ..... 84/291

FOREIGN PATENT DOCUMENTS 829284 6/1938 France ..... 84/267
1543589 4/1979 United Kingdom ..... 84/291

*Primary Examiner*—Lawrence R. Franklin
*Attorney, Agent, or Firm*—Schroeder, Siegfried, Vidas, Steffey & Arrett

[57] ABSTRACT

Acoustic guitar having three spaced sound holes and a modified back for producing improved sound of clean, sustaining quality.

16 Claims, 4 Drawing Figures

ACOUSTIC GUITAR

DESCRIPTION

BACKGROUND OF PRIOR ART

Acoustic guitars presently include a round sound hole located in the sound board at a centered position in the waist and upper bout of the guitar body and underneath the strings of the instrument. It has been determined that this is not the best location for the sound hole in that the instrument is unable to deliver the clean, brilliant sound from the body sound box that is put into it in the form of vibration tones put in action by the bridge.

The input sound to the guitar body sound box can be heard by laying one's ear on the guitar sound board near the bridge. When this is done, one hears the clean, brilliant input sound. However, without one's ear on the guitar sound board, the normally heard output sound of the guitar is heard as a "muddy" sound, when compared to the input sound heard with the ear against the guitar.

It is an object of this invention to provide a guitar of improved design which makes the normally heard output sound produced by the guitar for normal listening conditions more like that which is heard with one's ear against the guitar.

SUMMARY OF THE INVENTION

In accordance with the invention, three sound holes are included in the guitar sound board. The sound holes are positioned such that they are able to deliver the high and low tones produced by the guitar without substantial restraint and with a sustaining richness of marked quality and improved volume. In conjunction with the three sound holes, the interior surface of the guitar back is provided with a convex or inwardly bowed shape to aid in directing the sound out of the guitar body.

DESCRIPTION OF THE PREFERRED EMBODIMENT

Figure 1:
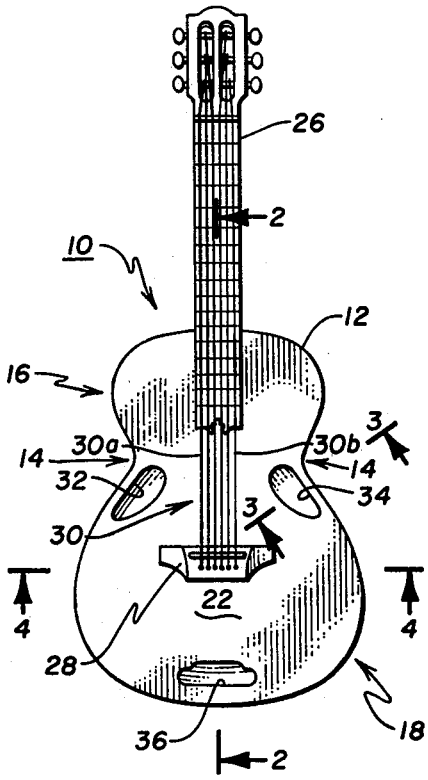
FIG. 1 is a face view of an acoustic guitar according to the invention.

Referring to FIG. 1, this invention relates to an improvement in acoustic guitars such as the one generally indicated at 10 having a guitar body or sound box 12. Hollow body 12 has a waist generally indicated at 14 which identifies the narrowest portion or midsection of the guitar. The portion of the guitar body above waist 14 is known as the upper bout and is generally designated in the Figure at 16. The portion of the guitar body below waist 14 is generally known as the lower bout and is generally designated in the Figure at 18.

Figure 2:
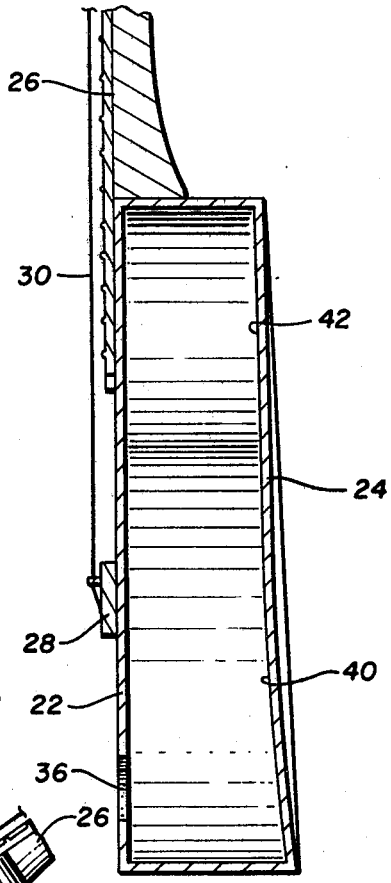
FIG. 2 is a sectional side elevational view taken along line 2—2 of FIG. 1 and slightly enlarged therefrom.
Figure 3:
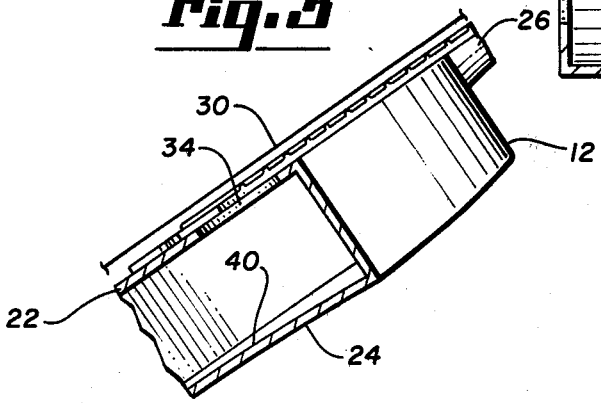
FIG. 3 is a sectional auxiliary elevational view taken along line 3—3 of FIG. 1 and slightly enlarged therefrom.
Figure 4:
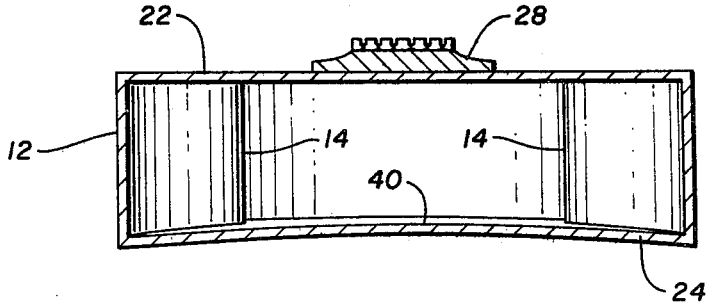
FIG. 4 is a sectional bottom plan view taken along line 4—4 of FIG. 1 and slightly enlarged therefrom.

The top 22, seen in FIG. 1, of guitar hollow body 12 is known as the sound board. The bottom 24, seen in FIGS. 2, 3 and 4, is known as the back of the instrument.

As is conventional in the guitar art, a neck 26 is attached to hollow body 12 to extend over sound board 22 as shown. A bridge 28 is also attached to sound board 22. Strings generally designated 30, including bass strings 30*a* and treble strings 30*b* extend along neck 26 and are received by bridge 28, thereby supporting strings 30 over sound board 22. Strings 30 are attached at the top of neck 26 in any conventional manner known in the art. The strings may be steel, gut or any other type string ordinarily used with an acoustic guitar.

According to one feature of the invention, three sound holes 32, 34 and 36 are formed in sound board 22. The locations of these three sound holes are, in large part, responsible for the improved sound produced by the guitar of this invention. These holes are preferably generally oval in overall shape in the preferred form of the invention as is shown in FIG. 1. However, any shape hole, particularly an oblong one, may be utilized according to the invention to improve the sound produced by a guitar. As can be seen, holes 32 and 34 are preferably positioned or located between waist 14 and bridge 28, the location of the holes being further defined, respectively, as being between the bass strings 30*a* and the adjacent edge of sound board 22 in the case of hole 32 and between the treble strings 30*b* in the adjacent edge of sound board 22 in the case of hole 34. Most preferably, the holes will be substantially aligned with the adjacent portion of the sound board edge with which they are associated as is shown in FIG. 1. However, generally speaking, insofar as holes 32 and 34 are concerned, it is only necessary that they be located between bridge 28 and upper bout 16 and between the respective strings and edge of sound board 22.

The location of hole 36 is in the lower bout, most preferably centered on the longitudinal center line of guitar body 12. Hole 36 is also preferably generally oblong in shape and aligned substantially with the adjacent edge of sound board 22 in lower bout 18 to which it is more closely positioned, relative to its position with respect to bridge 28. This positioning represents the most preferred form of the invention insofar as the location of hole 36 is concerned.

Another feature of the invention which in combination with the three holes represents the most preferred embodiment of my invention and which is in large part responsible for the improvement in sound provided thereby is found in an inwardly curved or convex inward surface of guitar back 24. This feature of the invention is best shown in FIGS. 2, 3 and 4 and, when used in combination with the three sound holes shown in FIG. 1, provides the most preferred embodiment of the invention which produces the most improved sound in an acoustic guitar. Generally speaking, this feature of the invention provides the back 24 of a guitar with the inner surface thereof convexly curved transverse of the longitudinal axis of the guitar body as shown at 40. FIG. 4 shows region 40 of back 24 as it curves inwardly in a direction transverse to the longitudinal axis in the lower bout. As seen in FIG. 2, region 40 is elongate, extending along the longitudinal axis of the guitar body and may be slightly convex in that direction as well, although this is not necessary. Also as seen in FIG. 2, region 42 in the upper bout may be included to provide a convex inner surface area in guitar body 12 although it is not necessary. It is most convenient for manufacturing purposes that the convex surface area be provided as is shown at 40 and 42 in FIG. 2. As can be seen from the Figure, the inner surface of back 24 in lower bout 18 at 40 curves inwardly more deeply than does the inner surface 42.

It is believed that the convex curvature provided by the inner surface of back 24 as described above aids in directing sound out of guitar body 12 through the three sound holes without the restraint which accompanied designs provided heretofore in the prior art. As shown, the curvature of back 24 can be provided by bowing the entire back inwardly in the desired location. However, it is also considered to be within the scope of the invention to provide a back 24 which is substantially flat at its exterior, but inwardly curved only on the inner surface thereof. This may be accomplished by shaping only the inner surface of the back or by including a suitably shaped insert.

Upon considering the foregoing description of several embodiments of this invention, those familiar with the art will become aware of many variations which can be incorporated into acoustic guitars in accordance with this concept. Having this in mind, the foregoing is illustrative of the invention and the exclusive rights pertaining thereto are defined by the following claims.

I claim:

1. In an acoustic guitar of the type having a body including a sound board and a back, a plurality of strings including bass and treble strings positioned above the sound board, and a bridge on the body sound board in the lower bout for receiving the strings, the improvement comprising an arrangement of three spaced sound holes in the sound board, the first hole being substantially located between the bridge and upper bout and between the bass strings and the adjacent edge of the guitar body sound board; the second hole being substantially located between the bridge and upper bout and between the treble strings and the adjacent edge of the guitar body sound board; and the third hole being located in the lower bout.

2. The guitar of claim 1 wherein the third hole is substantially centered on the longitudinal center line of the guitar body.

3. The guitar body of claim 2 wherein the inner surface of the back in the lower bout is curved inwardly along the direction of the longitudinal axis, the curvature being in the direction transverse thereto, to provide a relatively pronounced convex surface area inside the guitar body in the region of the lower bout and the inner surface of the back in the region of the upper bout is curved inwardly along the direction of the longitudinal axis, the curvature being primarily in the direction transverse thereto, to provide a relatively less pronounced convex surface area inside the guitar body in the region of the upper bout.

4. The guitar of claim 3 wherein the holes are generally oblong in shape.

5. The guitar body of claim 2 wherein the first and second holes are located between the waist and the bridge and the inner surface of the back in the lower bout is curved inwardly along the direction of the longitudinal axis, the curvature being primarily in the direction transverse thereto to provide a relatively pronounced convex surface area inside the guitar body in the region of the lower bout and the inner surface of the back in the region of the upper bout is curved inwardly along the direction of the longitudinal axis, the curvature being primarily in the direction transverse thereto, to provide a relatively less pronounced convex surface area inside the guitar body in the region of the upper bout.

6. The guitar of claim 5 wherein the oblong holes are oriented in the sound board in general alignment with the adjacent sound board edge.

7. The guitar of claim 1 wherein the first and second holes are located between the waist and the bridge.

8. The guitar of claim 7 wherein the holes are generally oblong in shape.

9. The guitar of claim 8 wherein the oblong holes are oriented in the sound board in general alignment with the respective adjacent sound board edge.

10. The guitar of claim 1 wherein at least a portion of the inner surface of the back in the region of the lower bout is curved inwardly along the direction of the longitudinal axis of the guitar body, the curvature being primarily in the direction transverse thereto, to provide a convex surface area inside the guitar body.

11. The guitar of claim 1 wherein the sound holes are generally oval in shape.

12. The guitar body of claim 1 wherein the inner surface of the back in the lower bout is curved inwardly along the direction of the longitudinal axis, the curvature being in the direction transverse thereto, to provide a relatively pronounced convex surface area inside the guitar body in the region of the lower bout and the inner surface of the back in the region of the upper bout is curved inwardly along the direction of the longitudinal axis, the curvature being in the direction transverse thereto to provide a relatively less pronounced convex surface area inside the guitar body in the region of the upper bout.

13. The guitar of claim 12 wherein the holes are generally oblong in shape.

14. The guitar of claim 13 wherein the oblong holes are oriented in the sound board in general alignment with the respective adjacent sound board edge.

15. The guitar of claim 1 wherein the sound holes are generally oblong in shape.

16. The guitar of claim 15 wherein the oblong holes are oriented in the sound board in general alignment with the respective adjacent sound board edge.

* * * * *